US006663204B2

(12) United States Patent
Atalla et al.

(10) Patent No.: US 6,663,204 B2
(45) Date of Patent: Dec. 16, 2003

(54) TWO PART REFRIGERATOR SHELF

(75) Inventors: Samir Atalla, Oakville (CA); James Matthew Yates, Dundas (CA); Ed Simmons, Hamilton (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/988,086

(22) Filed: Nov. 19, 2001

(65) Prior Publication Data

US 2002/0180323 A1 Dec. 5, 2002

(51) Int. Cl.[7] ..... A47B 96/02; A47F 5/08
(52) U.S. Cl. ..... 312/408; 211/153
(58) Field of Search ..... 312/401, 408, 312/410, 228.1; 108/108; 211/90, 134, 153, 126.9, 133.5

(56) References Cited

U.S. PATENT DOCUMENTS

| | | | | |
|---|---|---|---|---|
| 2,065,116 A | | 12/1936 | Constantine et al. | |
| 2,066,303 A | | 12/1936 | Schulz | |
| 2,091,607 A | | 8/1937 | Nave | 211/153 |
| 2,130,279 A | * | 9/1938 | Knight | 312/408 |
| 2,227,700 A | | 1/1941 | Buchanan | |
| 2,319,470 A | | 5/1943 | Nobles | 211/153 |
| 2,352,345 A | | 6/1944 | Rundell | 211/153 |
| 2,564,478 A | | 8/1951 | Harbison | 211/153 |
| 5,980,009 A | | 11/1999 | Atalla et al. | |

FOREIGN PATENT DOCUMENTS

| | | |
|---|---|---|
| CA | 609508 | 11/1960 |
| SE | 193892 | 1/1965 |

* cited by examiner

*Primary Examiner*—James O. Hansen

(57) ABSTRACT

A two part shelf for use in a refrigerator and preferably in a freezer compartment of a refrigerator has at least four shelf members mounted to the cabinet for supporting the two part shelf assembly. The two part shelf has a main shelf portion and an auxiliary shelf portion. The main shelf portion has a frame that supports a shelf floor that preferably extends from the rear wall towards an open front and partially across the width of the refrigerator cabinet. The main shelf portion has a rear frame member supported by at least two shelf support members and extends across the width of the cabinet beyond the width of the shelf floor. The auxiliary shelf portion has a second frame for supporting a second shelf floor. The second load supporting floor extends from the rear wall towards the open front and extends from one of the side walls towards the first load supporting floor of the main shelf portion. The second frame of the auxiliary shelf has a forward portion mounted by at least one of the shelf supports to the other side wall and the second frame is supported by the rear frame member to the first frame adjacent the rear wall. Studs are utilized to interconnect the two floors and support the frames of the main and the auxiliary shelf portions.

17 Claims, 4 Drawing Sheets

TWO PART REFRIGERATOR SHELF

FIELD OF THE INVENTION

This present invention relates to a two part shelf for use in a refrigerator cabinet, and in particular a shelf where one or both parts of the shelf may be used depending on the manner in which the cabinet space is used.

BACKGROUND OF THE INVENTION

In refrigerator shelving units, there has been considerable development in the past relating to the use of shelving ladders located along the rear wall of the refrigerator cabinet from which shelves may be supported in a cantilever fashion. This ladder shelving usually requires considerable reinforcement support behind the rear wall or of the refrigerator cabinet.

In top and bottom mount refrigerators where the freezer compartment is respectively located above and below the fresh food compartment, the freezer compartment typically has a single shelf arrangement located in this freezer compartment that spans the width of the freezer. Typically the single shelf arrangement is mounted on a series of studs that are mounted into the side walls or rear wall of the freezer compartment. While the single shelf mounting arrangement within the freezer compartment is less complex than the ladder type shelf mounting arrangements, the shelf needs to be properly supported at it's corners so as to permit for the shelf to carry a load without placing undo stress on the liner of the refrigerator cabinet. Also, while the single shelf construction permits for the entire shelf to be removed from the freezer compartment for the insertion of a ice maker or ice bucket, there is no flexibility to allow for a partial shelf removal.

A partial shelf removal feature is disclosed in U.S. Pat. No. 2,065,116 issued Dec. 22, 1936 to Constantine et al. The shelf is a single shelf which extends across the width of the refrigerator cabinet and has an opening in the self to one side of the cabinet. The opening in the shelf may be covered by a flat metal cover having a grill shaped pattern. The cover also carries beneath it a sliding basket. While such a construction provides flexibility in using the refrigerator shelf, the refrigerator shelf is supported in four locations and requires a front frame member that extends across the entire front width of the refrigerator cabinet. This front frame member partially obstructs direct access to the shelf opening by presenting an obstacle that objects must be carried over to be placed in an upright position within the shelf opening.

There is a need for a flexible refrigerator shelving assembly of simple construction which may readily facilitate the insertion and removal of taller items or an ice bucket into a position adjacent a main portion of the refrigerator shelf without having to carry articles over a cross member.

SUMMARY OF THE INVENTION

The present invention relates to a two-part shelf assembly for use in a refrigerator cabinet. The two-part shelf assembly comprises a first main shelf portion having a supporting floor or shelf within the refrigerator cabinet. This shelf extends partially within the refrigerator cabinet and has an open section which does not extend at least partially across the open front of the cabinet. This main shelf portion is preferably supported by at least three shelf support members mounted to the cabinet. The main shelf portion has a frame assembly for supporting the shelf or the floor and has a frame member that extends beyond the floor along either one of the cabinet side walls or rear wall. The two part shelf assembly further includes an auxiliary shelf portion which may be mounted adjacent to the main shelf portion. The auxiliary shelf portion has a supporting floor that is adapted to extend across that portion of the cabinet which the main shelf portion does not extend to provide shelf support across the open front of the cabinet. The auxiliary shelf portion is adapted to be supported by at least one shelf support member mounted to the cabinet and by flange or hooks overlying the frame member of the main shelf portion extending along either one of the side walls or the rear wall.

Additionally, it is contemplated that the two frames of the auxiliary shelf portion and the main frame portion may be interconnected by a load sharing interconnecting member such as for example, a spring like bracket carried by one of the two shelf portions and clipped to the other of the shelf portions along adjacent sections of the frame member. Alternatively, studs extending below and from each shelf portion under the other shelf portion may provide the load sharing interconnecting members.

The present invention provides a refrigerator shelf whereby the user may utilize a continuous shelf across the refrigerator cabinet or may remove a portion of the shelf for the use of larger articles or an ice maker where access into the cabinet through the open front is not obstructed by the shelf.

In accordance with one aspect of the present invention there is provided a two part shelf assembly for use in a refrigerator cabinet having a rear wall, two opposing side walls and an open front. The two part shelf assembly comprises at least four shelf support members mounted to the cabinet for supporting the two part shelf assembly, a main shelf portion and an auxiliary shelf portion. The main shelf portion has a first frame supporting a first load supporting floor. The first load supporting floor extends from the rear wall towards the open front and extends from one of the side walls partially across the width of the cabinet. The first frame has a forward portion mounted by at least one of the shelf supports to the one side wall. The first frame has a rear frame member supported by at least two shelf support members to the cabinet to extend across the width of the cabinet adjacent the rear wall. The auxiliary shelf portion has a second frame supporting a second load supporting floor. The second load supporting floor extends from the rear wall towards the open front and extends from the other one of the side walls partially across the width of the cabinet to lie adjacent and spaced from the first load supporting floor. The second frame has a forward portion mounted by at least one of the shelf support members to the other side wall. The second frame is supported by the rear frame member of the first frame adjacent the rear wall.

In accordance with another aspect of the present invention the main shelf portion may alternatively have a first load supporting floor that extends from the rear wall partially towards the open front and extends between the side walls. The first frame has a forward portion mounted by at least one of the shelf supports to one side wall and the first frame has a rear frame member supported by at least two shelf support members to the cabinet to extend across the depth of the cabinet adjacent the side walls. The auxiliary shelf portion may be inserted into the front opening across the cabinet and be supported to the frame member and to at least one shelf support member mounted to the cabinet.

BRIEF DESCRIPTION OF THE DRAWINGS

For a better understanding of the nature and objects of the present invention, reference may be had to the accompanying diagrammatic drawings in which.

DETAILED DESCRIPTION OF THE INVENTION

Figure 1:
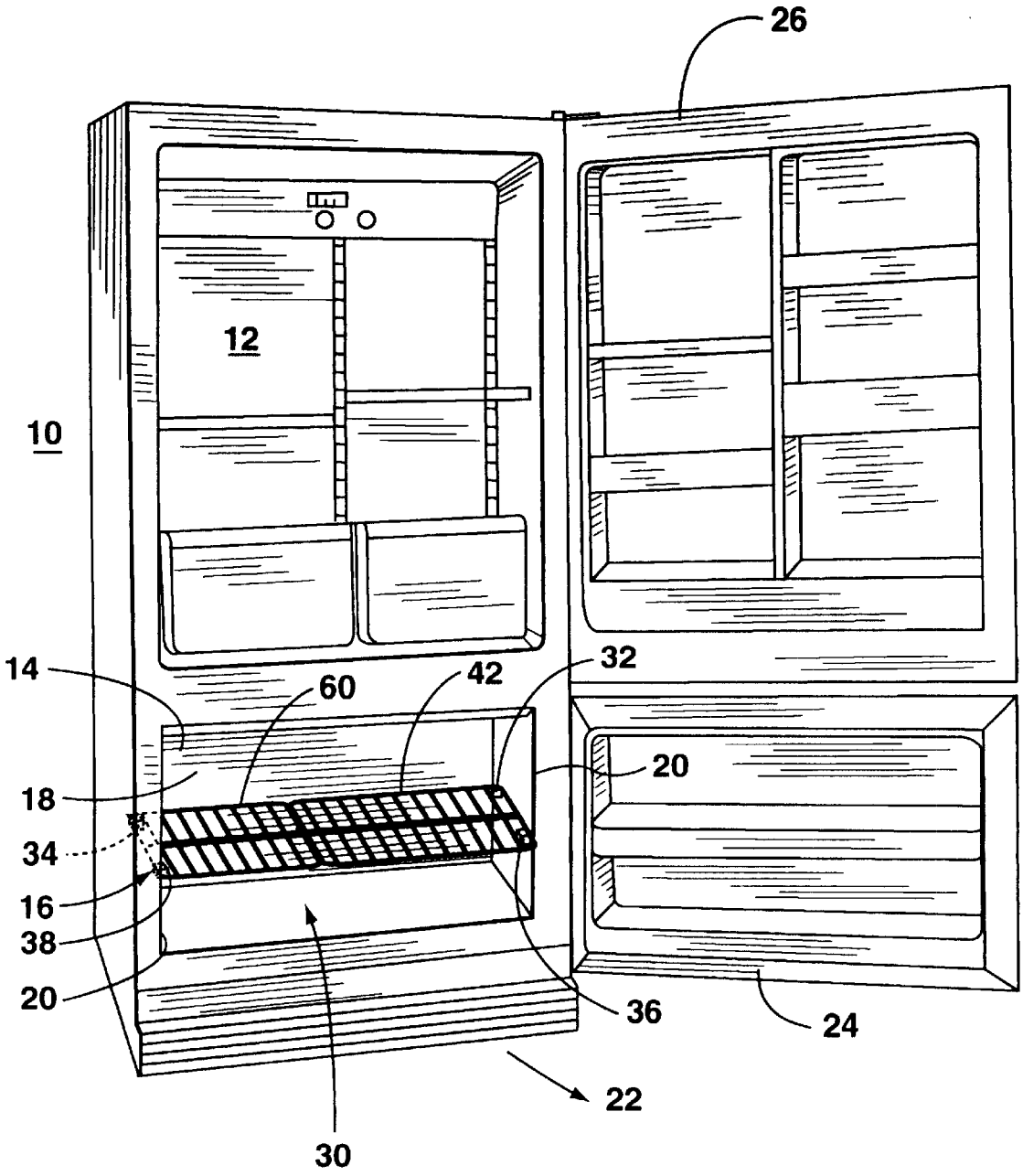
FIG. 1 is a front perspective view of a bottom mount refrigerator having the two part refrigerator shelf assembly of the present invention.

In FIG. 1, a bottom mount refrigerator 10 includes an upper fresh food compartment 12, closed by door 26, and a lower freezer compartment 14. The lower freezer compartment 14 has a cavity 16 with rear wall 18, opposing side walls 20, and an open front generally indicated by arrow 22. The open front 22 of the freezer compartment 14 is closed by door 24. Shelves, bins and trays are shown in the fresh food compartment 12 and on doors 24, 26 for storing food articles. In the freezer compartment 14 the two part shelf assembly 30 of the present invention is shown. It should be understood that the two part shelf assembly 30 may also be used in the fresh food compartment. Further, the refrigerator may be a top mount refrigerator where the freezer compartment is located above the fresh food compartment or a side by side refrigerator where the freezer compartment is located beside the fresh food compartment.

Figure 2:
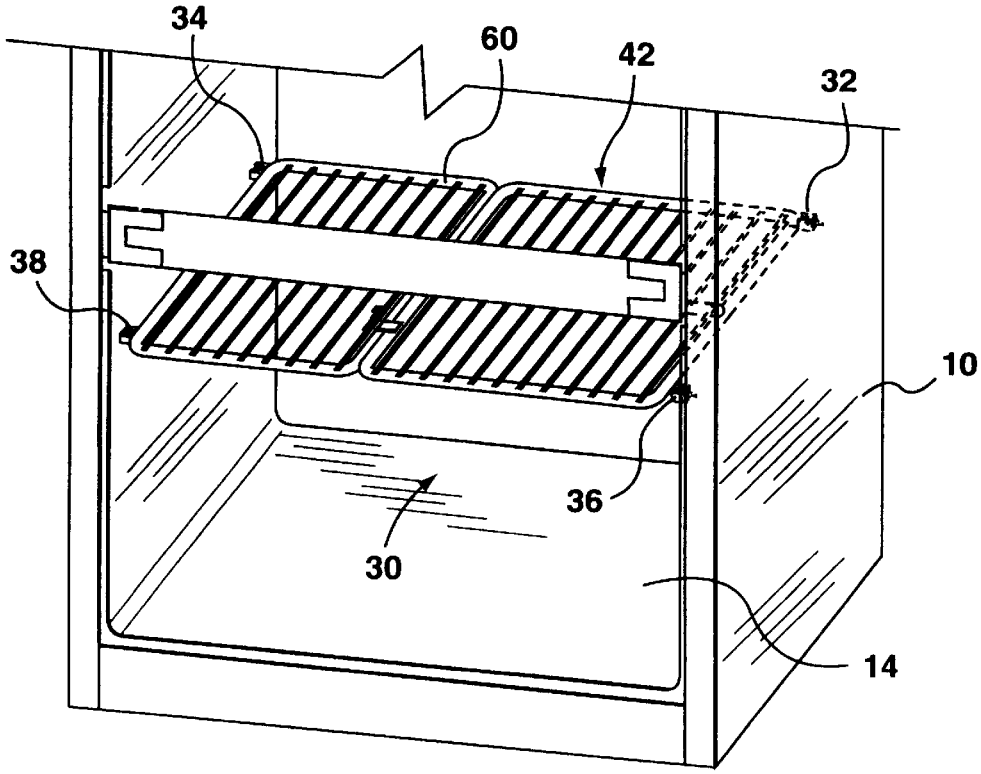
FIG. 2 is a partial front perspective view similar to FIG. 1.
Figure 3:
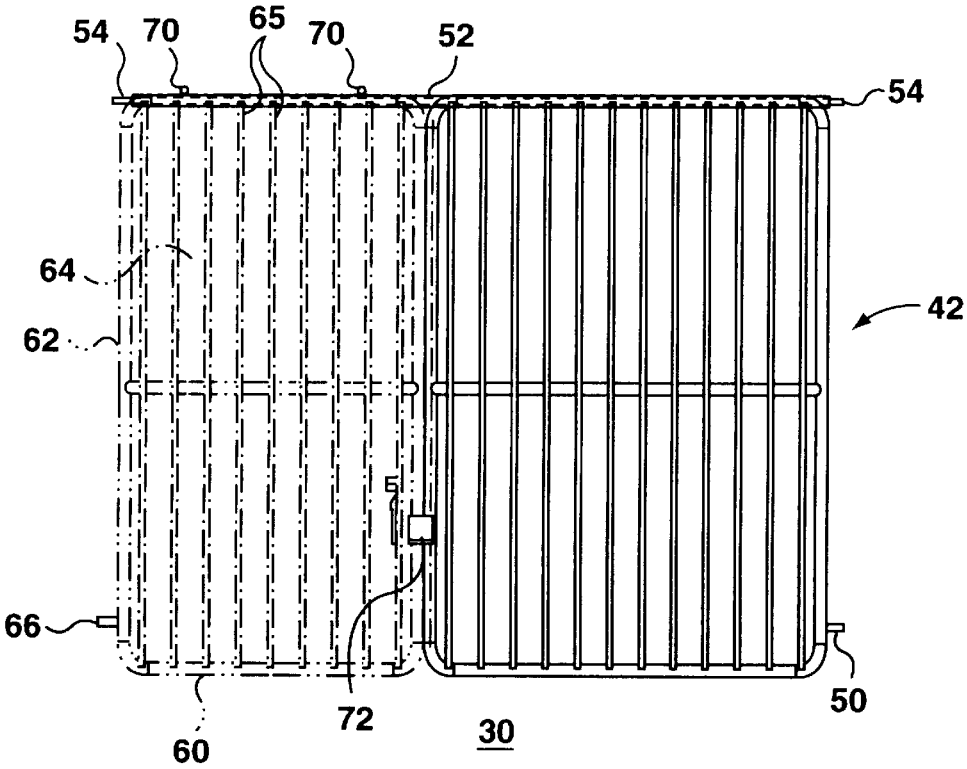
FIG. 3 is a plan view showing both the main and auxiliary shelf portions with the auxiliary shelf portion illustrated in broken line.
Figure 4:
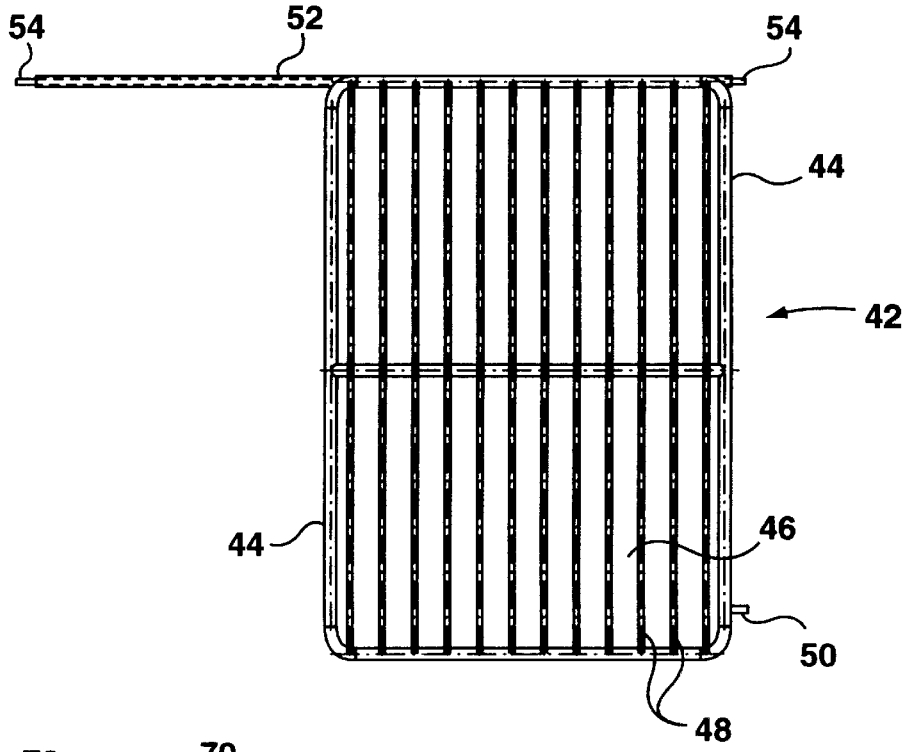
FIG. 4 is a plan view of the main shelf portion.
Figure 5:
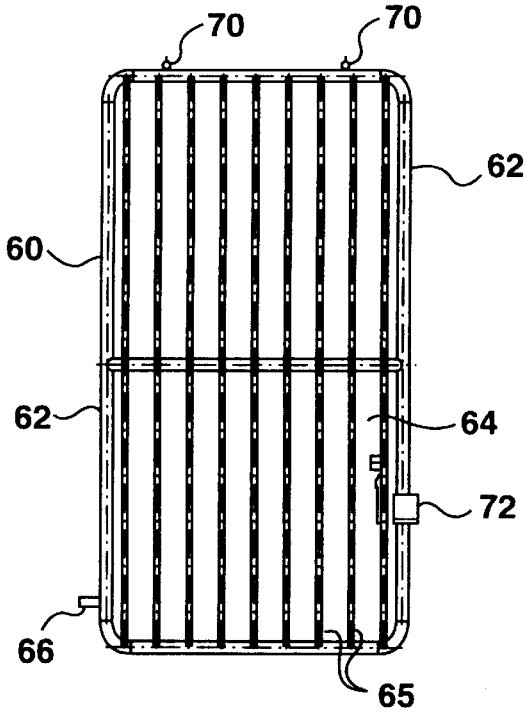
FIG. 5 is a plan view of the auxiliary shelf portion.
Figure 6:
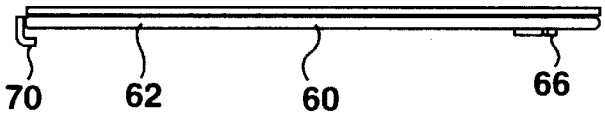
FIG. 6 is a side view of the auxiliary shelf portion.
Figure 7:
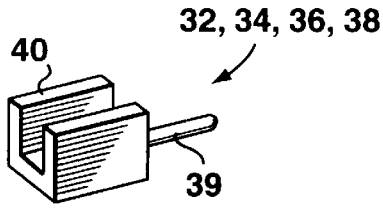
FIG. 7 is a perspective view of the shelf supporting member.

Referring to FIGS. 1 to 7, the two part refrigerator shelf assembly 30 comprises a main shelf portion 42 and an auxiliary shelf portion 60 which are supported by at least four shelf supporting members 32, 34, 36, and 38 solely from the rear wall 18 and opposing side walls 20 as shown in FIGS. 1 and 2. Throughout the disclosure and claims reference is made to the shelf assembly 30 as a "two part" assembly because the main shelf portion 42 and auxiliary shelf portion 60 each provide article support. It should be understood that this assembly further includes the shelf supporting members 32, 34, 36 and 38. These members each comprise a stud portion 39 mounted to the freezer cabinet 14 for supporting the two part shelf assembly 30. Each of the shelf supporting members 32, 34, 36, 38 has a U-shaped supporting bracket 40 adapted to hold the two part shelf assembly 30 that extends from the stud portion 39. It is noted that three of the shelf support members 34, 36 and 38 have U-shaped supporting brackets 40 that open in an upward direction and that one of the shelf support members 32 has a U-shaped supporting bracket 40 that opens towards the open front 22 of the freezer compartment or cabinet 14. The orientation of U-shaped brackets 40 permits for the main shelf portion 42 to be inserted into the refrigerator cabinet and then subsequently permits for the auxiliary shelf portion 60 to be inserted into the refrigerator cabinet and mounted relative to the side wall and the main shelf portion 42. Thus a user has the choice of utilizing the main shelf portion 42 by itself or in combination with the auxiliary shelf portion 60.

The main shelf portion 42 has a first frame 44 that supports a first load supporting floor 46. The first load supporting floor 46 comprises a plurality of parallel extending spaced apart rod members 48 mounted to the first frame 44. The first load supporting floor 46 extends from the rear wall 18 towards the open front 22 and at least partially across the width of the freezer compartment 14 from one of the side walls 20. The first frame 44 has a forward stem 50 mounted or inserted into the U-shaped bracket 40 of member 36 so as to support the stem 50 relative to one of the side walls 20. The first frame 44 has a rear frame member 52 which comprises an elongate bar that extends across the width of the cabinet adjacent the rear wall 18. The rear frame member has two opposing stems 54 and 56 which are inserted into the U-shaped brackets 40 of supporting members 32 and 34, respectively.

The auxiliary shelf portion 60 has a second frame 62 that supports a second load supporting floor 64 comprising a plurality of parallel extending spaced apart rods 65 mounted to the second frame 62. The second load supporting floor 64 extends from the rear wall 18 towards the open front 22 and extends from the other of the side walls 20 partially across the width of the freezer compartment 14 to lie adjacent and slightly spaced from the first load supporting floor 46 of the main shelf portion 44. The second frame 62 has a forward stem 66 that is mounted within the U-shaped bracket 40 of the shelf support member 38, so as to locate the second frame 62 relative to and supported from the other side wall 20. The second frame 62 is supported to the rear frame member 52 of the first frame 44 of the main shelf portion 42 adjacent the rear wall 18. The auxiliary shelf portion 60 has two spaced apart hook members 70 mounted to the second frame 62 and adapted to overlap or surround the rear frame member 52 of the first frame 42 adjacent the rear wall 18. In this manner, the second or auxiliary shelf portion 60 may be placed over the rear frame member 52 and pulled forward until the hooks 70 engage the rear frame member 52. Thereafter the auxiliary shelf portion is pivoted about the rear frame member so as to bring the forward stud portion 66 into engagement or supporting relation with the bracket 40 of the support stud 38.

To provide for further securement and limit relative movement between the main shelf portion 42 and the auxiliary shelf portion 60 the auxiliary shelf portion 60 carries on it's second frame 62 a U-shaped bracket member 72 which is crimped or spring locked in place. The U-shaped bracketing member 72 is adapted to snap over the first frame 44 of the main shelf portion 42 when the auxiliary shelf portion 60 is pivoted into position. This bracket 72 acts as a shelf interconnecting bracket and locks the main shelf portion relative to the auxiliary shelf portion.

Figure 8:
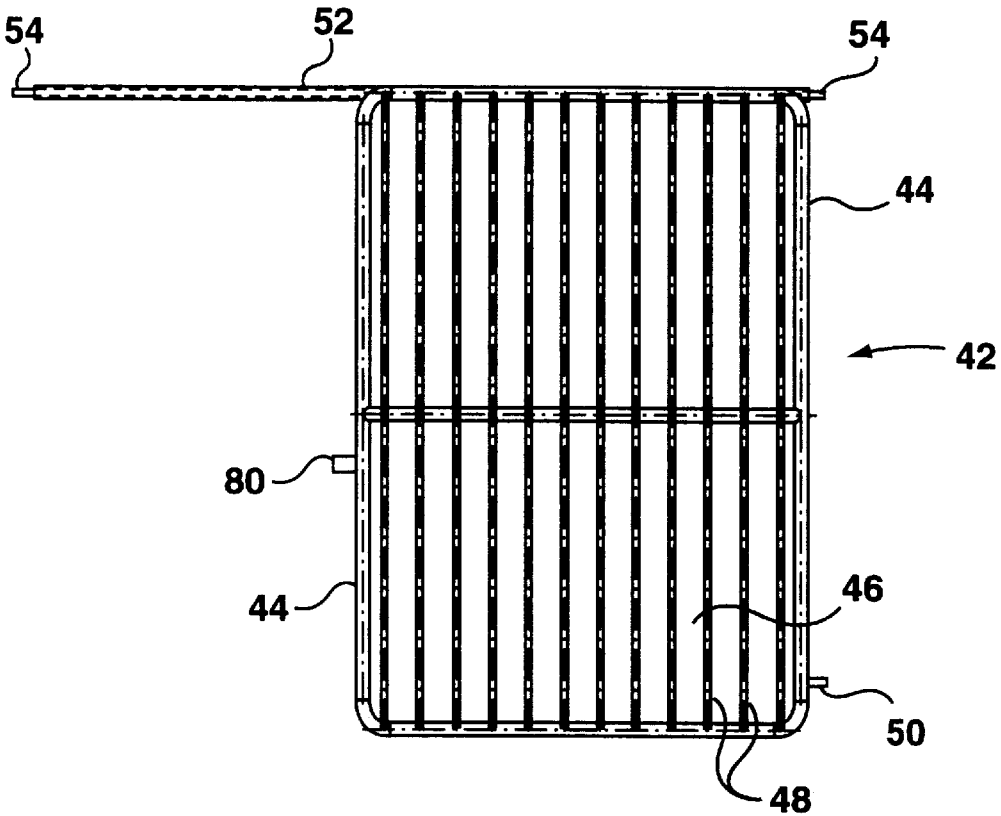
FIGS. 8 and 9 are views similar to FIGS. 4 and 5 showing stud load support interconnecting members.
Figure 9:
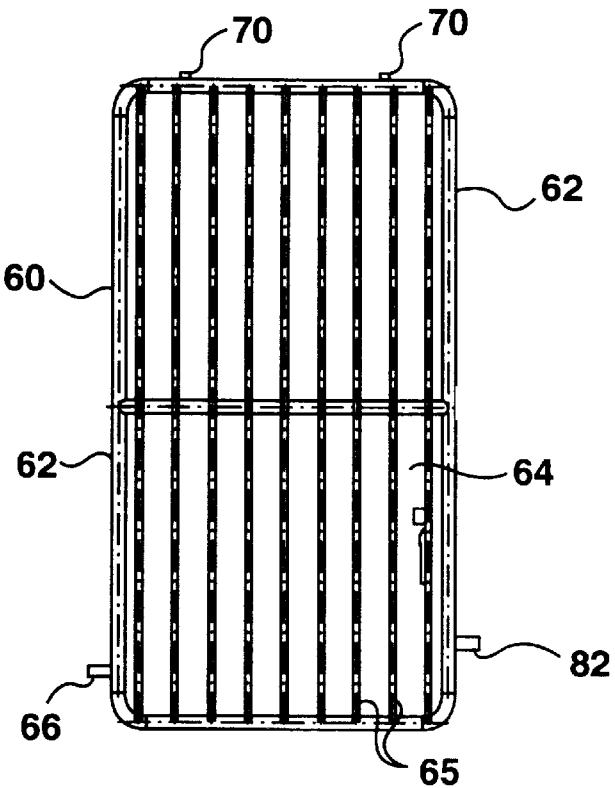

Referring to FIGS. 8 and 9, the main body portion 42 is shown with a first interconnecting stud 80 which extends out from the first frame 44 below the supporting floor 46. Also, the auxiliary shelf portion 60 has a second interconnecting stud 82 that extends away from frame 62 below the supporting floor 64. When the main shelf portion 42 is connected with the auxiliary shelf portion 60, stud 80 extends below and supports frame 62 and stud 82 extends below and supports frame 44. Studs 80 and 82 are spaced apart from each other to provide two interconnecting support locations.

It should be understood that the two part shelf assembly of the present invention is shown employed in a bottom mount refrigerator. However, the shelf could be utilized in a side by side refrigerator, or top or bottom mount refrigerator with the rear frame 52 extending along one of the side walls of the refrigerator such that the main shelf portion 42 is positioned back towards the rear of the refrigerator cabinet. The main body shelf portion 42 would extend across the width of the cabinet and partially toward the open front. The auxiliary shelf portion 60 would be placed in the cabinet forward of the main shelf portion 42.

Certain embodiments of the invention have been described in detail. From a reading of this disclosure, obvious modifications will be evident to those skilled in the art without departing from the spirit of the invention disclosed or from the scope of the appended claims.

What we claim is:

1. In a refrigerator cabinet having a rear wall, opposing first and second side walls and an open front, a two part shelf assembly comprising:

at least four shelf support members mounted to the rear wall and the opposing first and second side walls of the cabinet for supporting the two part shelf assembly solely from the rear wall and the opposing first and second side walls of the cabinet, a main shelf portion having a first frame supporting a first load supporting floor, the first load supporting floor extending from the rear wall towards the open front and extending from the first side wall partially across the width of the cabinet, the first frame having a forward portion mounted by at least one of the shelf support members to the first side wall, and the first frame having a rear frame member supported by at least two shelf support members to the cabinet to extend across the width of the cabinet adjacent the rear wall; and, an auxiliary shelf portion inserted into the cabinet and mounted relative to the main shelf portion and the second side wall of the cabinet, the auxiliary shelf portion having a second frame supporting a second load supporting floor, the second load supporting floor extending from the rear wall towards the open front and extending from the second side wall partially across the width of the cabinet to lie adjacent and spaced from the first load supporting floor, the second frame having a forward portion mounted by at least one of the shelf support members to the second side wall, and the second frame supported by the rear frame member of the first frame adjacent the rear wall.

2. The refrigerator cabinet assembly of claim 1 further comprising at least one load sharing interconnecting member extending from one of the main shelf portion and auxiliary shelf portion for supporting the other of the main shelf portion and auxiliary shelf portion.

3. The refrigerator cabinet assembly of claim 1 wherein the at least four shelf support members each comprises a U-shaped supporting bracket having a stud mounted into one of the first and second side walls of the cabinet.

4. The refrigerator cabinet assembly of claim 1 wherein the first and second load supporting floors each comprise a plurality of parallel spaced apart rod members mounted to a respective one of the first and second frames.

5. The refrigerator cabinet assembly of claim 1 wherein the auxiliary shelf portion further comprises two spaced apart hook members mounted to the second frame and adapted to extend about the rear frame member of the first frame that extends adjacent the rear wall.

6. The refrigerator cabinet of claim 1 wherein the second frame is pivotally supported to the rear frame member of the first frame adjacent the rear wall and the forward portion is thereafter mounted to the second support wall.

7. The refrigerator cabinet of claim 6 wherein pivotal support for the auxiliary shelf portion comprises two spaced apart hook members mounted to the second frame and adapted to surround the rear frame member of the first frame adjacent the rear wall.

8. In a refrigerator having a refrigerated food cabinet having an open front, a rear wall and opposed first and second side walls, a two part shelf assembly comprising:

at least four shelf support members mounted to the rear wall and the opposing first and second side walls of the cabinet for supporting the two part shelf assembly solely from the rear wall and the opposing first and second side walls of the cabinet, a main shelf portion having a first frame supporting a first load supporting floor, the first load supporting floor extending from the rear wall towards the open front and extending from the first side wall partially across the width of the cabinet, the first frame having a forward portion mounted by at least one of the shelf support members to the first side wall, and the first frame having a rear frame member supported by at least two shelf support members to the cabinet to extend across the width of the cabinet adjacent the rear wall;

an auxiliary shelf portion inserted into the cabinet and mounted relative to the main shelf portion and the second side wall of the cabinet, the auxiliary shelf portion having a second frame supporting a second load supporting floor, the second load supporting floor extending from the rear wall towards the open front and extending from the second side wall partially across the width of the cabinet to lie adjacent and spaced from the first load supporting floor, the second frame having a forward portion mounted by at least one of the shelf support members to the second side wall, and the second frame supported by the rear frame member of the first frame adjacent the rear wall; and, at least one load sharing interconnecting member extending from one of the main shelf portion and auxiliary shelf portion for securement with the other of the main shelf portion and auxiliary shelf portion to share loading between the main shelf portion and auxiliary shelf portion.

9. The refrigerator cabinet assembly of claim 8 wherein the at least four shelf support members each comprises a U-shaped supporting bracket having a stud mounted into one of the first and second side walls of the cabinet.

10. The refrigerator cabinet assembly of claim 8 wherein the first and second load supporting floors each comprise a plurality of parallel spaced apart rod members mounted to a respective one of the first and second frames.

11. The refrigerator cabinet assembly of claim 8 wherein the auxiliary shelf portion further comprises two spaced apart hook members mounted to the second frame and adapted to extend about the rear frame member of the first frame that extends adjacent the rear wall.

12. The refrigerator cabinet of claim 8 wherein the second frame is pivotally supported to the rear frame member of the first frame adjacent the rear wall and the forward portion is thereafter mounted to the second support wall.

13. The refrigerator cabinet of claim 12 wherein pivotal support for the auxiliary shelf portion comprises two spaced apart hook members mounted to the second frame and adapted to surround the rear frame member of the first frame adjacent the rear wall.

14. In a refrigerator having a refrigerated food cabinet having an open front, a rear wall and opposed first and second side walls, a two part shelf assembly comprising:

at least four shelf support members mounted to the rear wall and the opposing first and second side walls of the cabinet for supporting the two part shelf assembly solely from the rear wall and the opposing first and second side walls of the cabinet, a main shelf portion having a first frame supporting a first load supporting floor, the first load supporting floor extending from the rear wall partially towards the open front and extending between the first and second side walls, the first frame having a forward portion mounted by at least one of the shelf support members to the first side wall, and the first frame having a rear frame member supported by at least two shelf support members to the cabinet to extend across the depth of the cabinet adjacent one of the first and second side walls; and, an auxiliary shelf portion inserted into the cabinet and mounted relative to the main shelf portion and the second side wall of the cabinet, the auxiliary shelf portion having a second frame supporting a second load supporting floor, the second load supporting floor extending from the first load supporting floor towards the open front and extending between the first and second side walls across the width of the cabinet to lie adjacent and spaced from the first load supporting floor, the second frame having a forward portion mounted by at least one of the shelf support members to the second side wall, and the second frame supported by the side frame member of the first frame adjacent the one side wall.

15. The refrigerator cabinet assembly of claim 14 further comprising at least one load sharing interconnecting member extending from one of the main shelf portion and auxiliary shelf portion for supporting the other of the main shelf portion and auxiliary shelf portion.

16. The refrigerator cabinet assembly of claim 15 wherein the at least four shelf support members each comprises a U-shaped supporting bracket having a stud mounted into one of the first and second side walls of the cabinet.

17. The refrigerator cabinet assembly of claim 14 wherein the auxiliary shelf portion further comprises two spaced apart hook members mounted to the second frame and adapted to extend about the side frame member of the first frame that extends adjacent the side wall.

* * * * *